US005507654A

United States Patent [19]

Daly et al.

[11] Patent Number: 5,507,654

[45] Date of Patent: Apr. 16, 1996

[54] LOW PROFILE ELECTRICAL ADAPTOR

[75] Inventors: John J. Daly, Chicago; Daniel S. Poplawski, Montgomery; Jaime Duran, Chicago, all of Ill.

[73] Assignee: Methode Electronics, Inc., Chicago, Ill.

[21] Appl. No.: 421,022

[22] Filed: Apr. 12, 1995

Related U.S. Application Data

[63] Continuation of Ser. No. 163,008, Dec. 7, 1993, abandoned.

[51] Int. Cl.[6] ..... H01R 31/06

[52] U.S. Cl. ..... 439/76.1; 439/862

[58] Field of Search ..... 439/76, 83, 876, 439/638, 620, 862

[56] References Cited

U.S. PATENT DOCUMENTS

| | | | |
|---|---|---|---|
| 4,390,219 | 6/1983 | Beehler | 439/92 |
| 4,585,284 | 4/1986 | Koser et al. | 439/350 |
| 4,726,793 | 2/1988 | Bright | 439/751 |
| 4,857,002 | 8/1989 | Jensen et al. | 439/76 |
| 4,930,200 | 6/1990 | Brush, Jr. et al. | 439/607 |
| 4,934,944 | 6/1990 | Kozel et al. | 439/68 |

FOREIGN PATENT DOCUMENTS

| | | | |
|---|---|---|---|
| 63-269466 | 11/1988 | Japan | 439/83 |

OTHER PUBLICATIONS

Research Disclosure; Surface Solder Harcon Connector; No. 31552; Kenneth Mason Publications Ltd.; Jul. 1990.

*Primary Examiner*—Neil Abrams
*Attorney, Agent, or Firm*—David L. Newman

[57] ABSTRACT

A low profile electrical adaptor having a high density connector press-fit to a first side of a circuit carrying substrate and a low density connector surface mounted to a second side of the circuit carrying substrate providing for a low profile adaptor assembly having the circuit carrying substrate parallel to the base of the adjacent connectors.

19 Claims, 2 Drawing Sheets

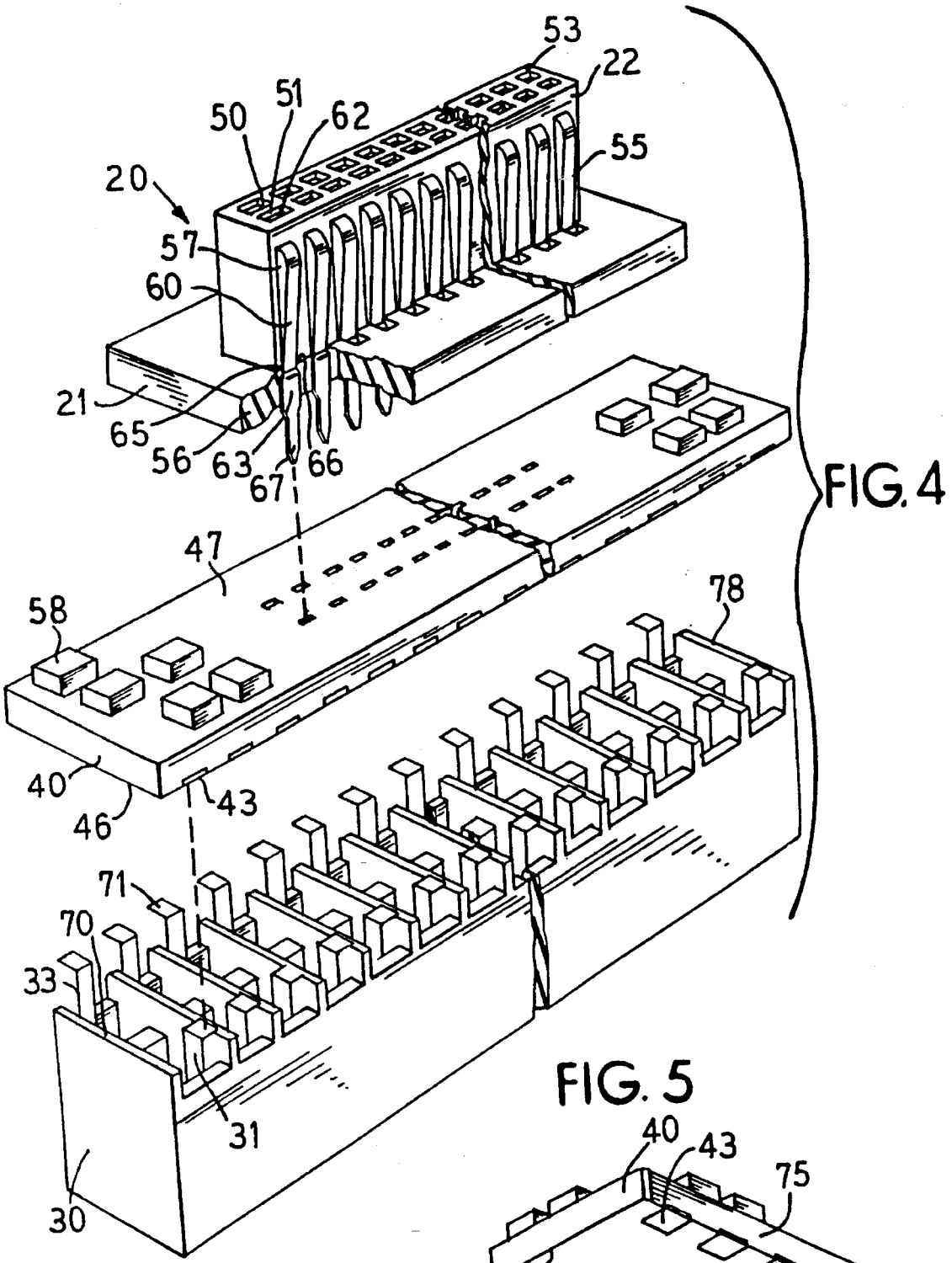
FIG. 4
FIG. 5
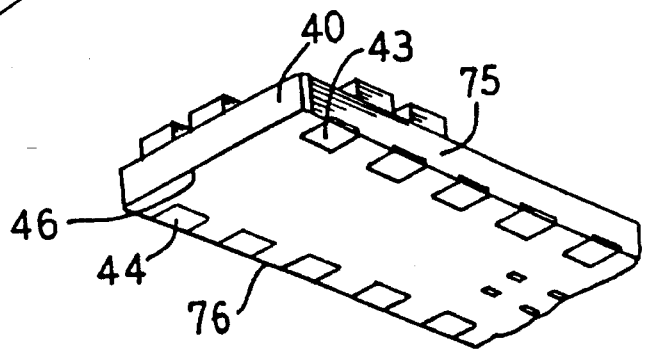

LOW PROFILE ELECTRICAL ADAPTOR

This is a continuation of application Ser. No. 08/163,008, filed Dec. 7, 1993, now abandoned.

BACKGROUND OF THE INVENTION

This invention pertains to electrical connectors and, in particular, a connector having new and improved contacts which provide for a low profile housing which provides for an adaptor of a high density connector to a low density connector.

Electrical adaptors for allowing an electrical connector of a low density orientation connect to an electrical connector of high density orientation are increasingly demanded by industry. As miniaturization of components forces electrical connections to become more densely spaced, high density electrical connectors are frequently required. However, the high density connector in many cases must mate with connectors having different spacing. For example, SMALL COMPUTER STANDARD INTERFACE (SCSI) has increased its density as the standard has progressed. SCSI I requires a 50-position connector having 100 inch spacing and SCSI II requires a 68-position connector having 0.050 inch spacing. In order to mate a SCSI I with SCSI II component, an adaptor is required which is small and is easily manufactured.

Many adaptors also require advanced circuitry and include circuit carrying substrates to carry active devices and interconnect the high and low profile connectors. It has been known in the art to connect a contact to a circuit carrying substrate via press-fit mounting. This is accomplished by the pins of the contact being inserted into plated-through holes which tightly hold the pins. It is also known in the art to mount a connector to a circuit carrying substrate via surface mount. This is accomplished by the tails of the contact being shaped to be parallel to the surface of the circuit carrying substrate and being soldered to pads on the surface of the substrate. However, in general, electrical adaptors have been attached to circuit carrying substrates by soldering the contacts of the connectors to the sides of the circuit carrying substrate. This is a time-consuming and expensive process to solder each individual contact to the edge of the circuit carrying substrate. As well, this requires that the circuit carrying substrate be parallel to the connectors, standing upright having the width of the board separating the two connectors and increasing the profile or height of the overall adaptor. As the width of a circuit carrying substrate is substantial in that it must carry all of the traces of the connector in addition to any active or passive devices such as integrated circuits or resistors or capacitors printed or not printed, this would increase the profile of the connector making it disadvantageous.

It is an object of the present invention to provide a low profile adaptor which limits the height of the adaptor.

It is a further object of the present invention to provide an adaptor which is easily and inexpensively manufactured.

SUMMARY OF THE INVENTION

A principal object of this invention is to provide an adaptor which incorporates a circuit carrying substrate which is mounted parallel to the base of two connectors forming a connector-circuit carrying substrate sandwich. The connector on a first side of the circuit carrying substrate is press-fit to the circuit carrying substrate. The connector on a second side of the circuit carrying substrate is surface mounted. The circuit carrying substrate includes a plurality of holes therethrough and solder pads on its second side. The connector of the first side includes contacts having contact tails which are pins which are perpendicular to the surface of the circuit carrying substrate and mate with the corresponding holes of the circuit carrying substrate. The connector of the second side of the circuit carrying substrate includes contacts having contact tails which are parallel to the surface of the circuit carrying substrate and which mount on the solder pads of the second side of the circuit carrying substrate.

BRIEF DESCRIPTION OF THE DRAWINGS

There is shown in the drawings a presently preferred embodiment of the adaptor, wherein like numerals in the various figures pertain to like elements, and wherein:

FIG. 4 is an exploded perspective view of the adaptor; and

FIG. 5 is a bottom perspective view of a circuit carrying substrate of the adaptor.

DETAILED DESCRIPTION OF THE PRESENTLY PREFERRED EMBODIMENTS

Figure 1:
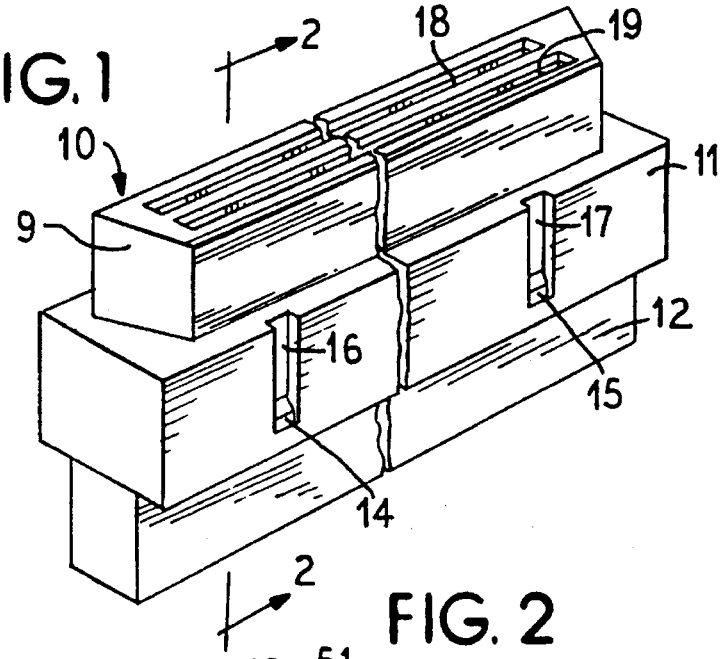
FIG. 1 is a perspective view of the connector and housing of the adaptor.

FIG. 1 is a perspective view of the adaptor 10 of an embodiment of the present invention having a housing attached thereto. In a presently preferred embodiment of the invention a top housing 11 covers the high density side of the adaptor 10 and bottom housing 12 covers the low density side of the adaptor 10. The bottom housing 12 is placed over the low density side of the adaptor having tabs 14,15 protruding from the side of bottom housing 12. Top housing 11 is then placed over the high density side of adaptor 10. Grooves 16,17 engage tabs 14,15, respectively by tabs 14,15 snapping over the bottom edge of groove 16, 17 to hold top housing 11 over adaptor 10. In a preferred embodiment of the invention, the adaptor is a female-by-female electrical connector. However, this invention also includes adaptors which may be male-by-male or male-by-female. The top housing 11 of a preferred embodiment includes tapered wall 9 to provide for polarization of the high density connector for proper orientation when mated to a corresponding connector. The top housing 11 includes openings 18,19 for receiving male contact members. Openings 18,19 provide a communication passage to the high density connector of the adaptor 10.

Figure 2:
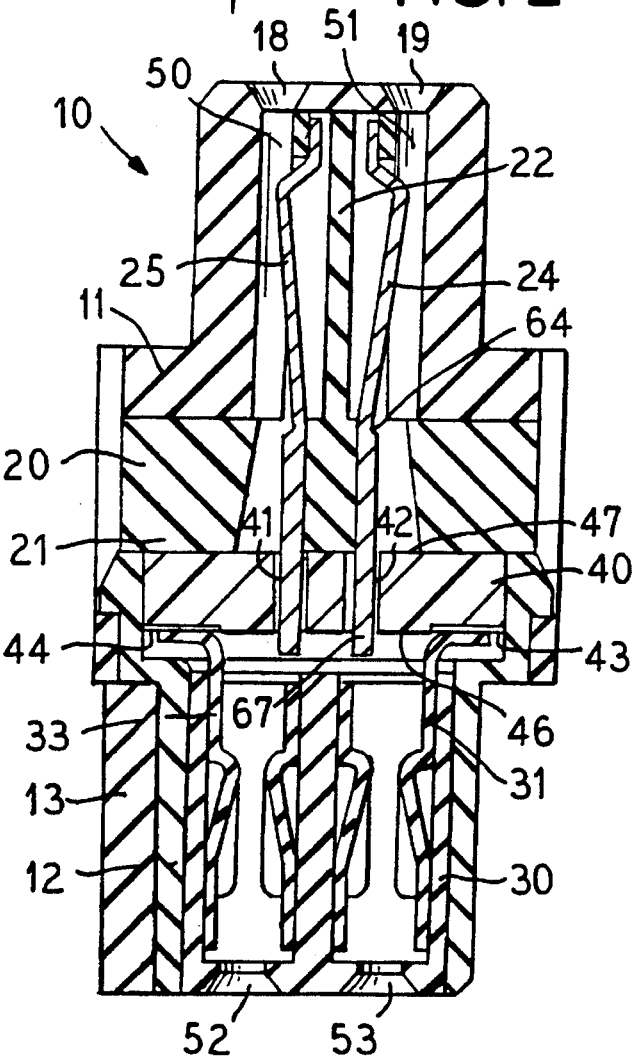
FIG. 2 is a side cut-away view of the connector and a housing of the adaptor taken at line 2—2 of FIG. 1.

FIG. 2 is a side elevation cut-away taken at line 2—2 of FIG. 1 of the adaptor 10. Top housing 11 covers high density connector 20 having base portion 21, upper portion 22 and high density contacts 24,25. Bottom housing 12 is shown enclosing low density connector 30 having low density contacts 31,33. Sandwiched between high density connector 20 and low density connector 30 is circuit carrying substrate 40. The circuit carrying substrate 40 includes plated through holes 41,42 and conductive pads 43,44 on a second side 46 of the circuit carrying substrate 40. The high density connector 20 is mounted to a first side 47 of the circuit carrying substrate 40.

Communication passages 18,19 of top housing 11 open into contact passages 50,51 of the high density connector 20. Contact passages 52,53 of low density connector 30 are shown allowing insertion of a male contact member to come into communication with the contacts 31,33. The housing 12 of the low density connector 30 includes a polarizing key 13 for proper orientation of the low density connector 30 when mated to a corresponding connector.

Figure 3:
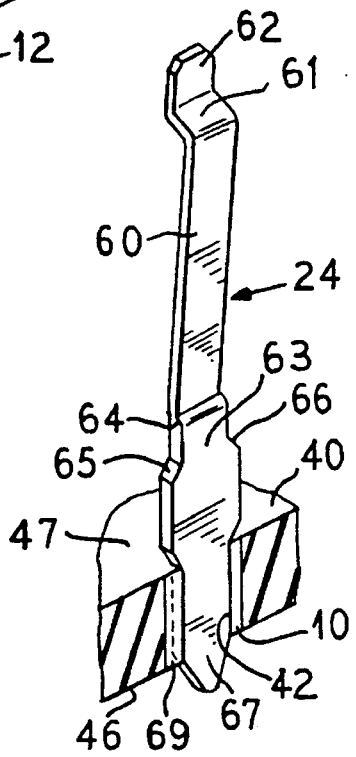
FIG. 3 is a perspective view of a contact of the adaptor inserted into a circuit carrying substrate.

Turning to FIG. 3, the contact 24 is shown in a perspective view press-fit into circuit carrying substrate 40. In a preferred embodiment, the substrate is a printed circuit board made of FR4 which is the American National Standard Institute generic type for a flame retardant glass based epoxy resin impregnated laminate. However, in an alternative embodiment, the circuit carrying substrate comprises a molded plastic substrate such as liquid crystal polymer having conductive ink traces adhered thereto. The conductive ink may be Methode Development Co. #1212 conductive silver or ORMET 1100 (Toranaga Industries). This alternative embodiment, using conductive ink, does not include the plated-through holes 69,70 of the preferred embodiment. Instead, the conductive ink may act as a communication pathway from a first side 47 of the circuit carrying substrate 40 to a second side 46 of the substrate 40. Either the conductive ink may be coated inside the hole 42 of the substrate 40, or the contact tail 67 may be inserted in a non-coated hole and make contact with conductive ink which surrounds the perimeter of the hole 42 on a first side 47 of the circuit carrying substrate 40 and simultaneously contact the conductive ink which surrounds the perimeter of the hole 42 at a second side 46 of the substrate 40.

In a preferred embodiment, the contact 24 includes a main beam 60 which has a width of approximately 0.025 inches. At the top of the main beam 60 is a convoluted area 61 and head 62. The main beam portion 60 of the contact 24 has a thickness of 0.010 inches. The base 63 has a greater thickness than main beam 60 in that the contact 24 bulges at point 64 providing a thickness of 0.016 inches. This increased thickness is to provide for proper contact and press-fitting of the contact 24 in the circuit carrying substrate 40. Base portion 63 of contact 24 includes shoulders 65,66 which increase the width of the contact 24 to 0.036 inches. These shoulders 65,66 help retain the contact 24 within the insulation of high density connector 22 (see FIG. 4). Contact tail 67 is inserted into plated-through hole 42 of circuit carrying substrate 40. Plating 69,70 surrounds the inside of hole 42 to provide electrical contact between the plating 69,70 and contact 24. The plating 69,70 is connected to a selected array on the circuit carrying substrate and in the presently preferred embodiment is connected through pads 44,43 (FIG. 2) to the low density connector 30. In the assembled adaptor (FIG. 2) contact tail 67 is limited in its insertion through circuit carrying substrate 40 so that low density connector 30 may be mounted closely to the contact pads 43,44 and circuit carrying substrate 40 to provide a low profile adaptor. The length of the overall contact 24 in a preferred embodiment is 0.425 inches.

FIG. 4 shows an exploded perspective view of the adaptor of the present invention. High density connector 20 is shown having base portion 21 and upper portion 22. Contact passages 50,51 are shown along the top 53 of upper portion 22. Contacts 55 are mounted in the insulation 56 of the connector 20. Passages 51 extend through the entire height of the high density connector 20 and are open along their outer side at opening 57. Head portion 62 is visible in passage 51. In its nonengaged position, the contacts 55 bulge outwardly so that head 62 rests against the outer wall of passage 51. Upon engagement of a male contact against contact 55, the main beam 60 of the contact will be pressed back into side opening 57 causing contact head 62 to rest nearer the inner wall of passage 51. As contacts 55 are retained securely within insulation 56 due to shoulders 65 and 66 of enlarged width area of the base 63 of the contact 55, the base 66 of the contact 55 remains in a constant position as the beam 60 is retracted into side opening 57 upon mating with another connector.

The high density connector 20 is mounted to a first side 47 of the circuit carrying substrate 40 via press-fit mating of the contact tail 67 into the corresponding plated-through holes 42 of the circuit carrying substrate 40. The contact tails 67 are carefully stamped so that they tightly fit within the plated-through holes 42 of the circuit carrying substrate 40. This press-fit mating of the high density connector 20 to the circuit carrying substrate provides for electrical contact between each contact 55 of the high density connector 20 through the plated-through holes 42 to traces of the circuit carrying substrate 40 which connect to conductive pads 43 on a second side 46 of the circuit carrying substrate 40. The circuit carrying substrate 40 may include active or passive devices 58 which are connected to a selected array and the plated-through holes 42. In a preferred embodiment of the present invention, passive devices 58 are capacitors which are mounted to a first side 47 of the circuit carrying substrate 40 and provide capacitive load for the end signal lines of the high density connector 20 which do not have a corresponding signal line in low density connector 30.

Low density connector 30 includes an insulation housing having passages 70 in which reside contacts 31,33. Contacts 31,33 include contact tails 71 which are formed perpendicular to the body of contacts 31 and parallel to the base of the low density connector 30. The contact tails 71 are also parallel to the surface of the circuit carrying substrate 40. Upon mounting the low density connector 30 onto circuit carrying substrate 40, the contact tails 71 mate with the corresponding conductive pads 43 and are surface mounted thereto via the application of heat. In a preferred embodiment, hot vapor is directed to the second side 46 of the circuit carrying substrate 40 to cause the conductive paste of conductive pad 43 to flow and adhere to the contact tail 71 of the contacts of the low density connector 30. In a presently preferred embodiment, the low density connector 30 of the invention includes two rows of fifty (50) contacts. Correspondingly, the second side 46 of the circuit carrying substrate 40 of the preferred embodiment of the invention includes two rows of fifty (50) conductive pads. The presently preferred embodiment of the high density connector 20 includes two rows of sixty-eight (68) contacts and correspondingly, the circuit carrying substrate includes two rows of sixty-eight (68) holes extending therethrough.

FIG. 5 shows a bottom perspective view of the circuit carrying substrate 40 of the present invention. This perspective view shows in particular second side 46 of circuit carrying substrate 40 showing conductive pads 43,44. Two rows of conductive pads 43,44 are shown. A first row of pads 43 are shown along first edge 75 of the circuit carrying substrate 40 and a second row 44 are located along a second edge 76 of the circuit carrying substrate 40.

In a preferred embodiment, the contacts 55 and passages 50,51 are spaced on 0.050 inch centers. The contacts 31,33 and passages 70 of the low density connector 30 are spaced on 0.100 inch centers. As is shown in FIG. 4, the novel method of mating the two connectors of the present invention via press-fit on the first side 47 and surface-mounting on the second side 46 allow the circuit carrying substrate 40 to remain in a position which is parallel to the base 21 of high density connector 20 and base 78 of low density connector 30 to make a connector-circuit carrying substrate sandwich which is of a low profile. This method of mating the connectors to a circuit carrying substrate provides for an adaptor having an overall height of 0.71 inches in a preferred embodiment of the invention.

The description above has been offered for illustrative purposes only, and it is not intended to limit the scope of the invention of this application which is defined in the following claims.

We claim:

1. A low profile electrical adaptor for combining a low density connector with a high density connector having male contacts, said electrical adaptor comprising:

a circuit carrying substrate formed of insulated material and defining a plurality of holes therethrough;

a first connector mounted to a first side of said circuit carrying substrate and having a plurality of pairs of opposite facing high density leaf spring contacts for interconnecting with said male contacts, said high density leaf spring contacts including contact tails extending through said holes;

surface mount conductive pads on a second side of said circuit carrying substrate for providing a low density contact mounting surface;

a second connector mounted to said second side of said circuit carrying substrate and having a plurality of low density contacts mounted to said surface mount conductive pads; and said circuit carrying substrate being parallel to the base of said first and second connector.

2. The electrical adaptor of claim 1 comprising:

said second connector including said low density contacts having contact tails parallel to said circuit carrying substrate; and said contact tails conductively mounted to said circuit carrying substrate at said corresponding surface mount conductive pads.

3. The electrical adaptor of claim 1 wherein said circuit carrying substrate includes capacitors adhered thereto.

4. The electrical adaptor of claim 1 including electrically conductive plating extending through said holes.

5. The electrical adaptor of claim 1 wherein said circuit carrying substrate includes two rows of 68 holes.

6. The electrical adaptor of claim 1 wherein said circuit carrying substrate includes two rows of 50 conductive pads.

7. The electrical adaptor of claim 5 wherein said two rows of holes are centered on the said circuit carrying substrate.

8. The electrical adaptor of claim 6 wherein said first row of conductive pads is at a first edge of the circuit carrying substrate; and said second row of said conductive pads are at a second edge of said circuit carrying substrate.

9. The electrical adaptor of claim 2 wherein said first connector includes a housing having 68 positions.

10. The electrical adaptor of claim 1 wherein said second connector includes a 50 position connector.

11. The electrical adaptor of claim 9 wherein said first connector includes spacing of 0.050 inches.

12. The electrical adaptor of claim 10 wherein said low density contacts have 0.100 inch centers.

13. A low profile electrical adaptor providing connection between a high density connector having male contacts and a low density connector, said adaptor comprising:

a circuit carrying substrate formed of insulated material and defining a plurality of holes therethrough;

a first connector having high density leaf spring contacts for interconnecting with said male contacts, said high density leaf spring contacts having tails which extend through said holes from a first side of said circuit carrying substrate; and a second side of said circuit carrying substrate having surface mount conductive pads;

a second connector having low density contact members mounted to said surface mount conductive pads.

14. The electrical adaptor of claim 13 wherein said circuit carrying substrate is a printed circuit board made of FR4.

15. The electrical adaptor of claim 14 wherein said circuit carrying substrate includes:

a molded plastic substrate; and conductive ink carried by said molded plastic substrate.

16. The electrical adaptor of claim 15 wherein said molded plastic is a liquid crystal polymer.

17. The electrical adaptor of claim 15 wherein said conductive ink is ORMET 2000.

18. The electrical adaptor of claim 15 including conductive ink providing a communication pathway from said first side of said circuit carrying substrate to said second side of said substrate.

19. A low profile electrical adaptor for combining a low density connector with a high density connector, said electrical adaptor comprising:

a circuit carrying substrate formed of insulated material, said circuit carrying substrate having a first side and an opposite second side, said first side having a plurality of holes therethrough and said second side having surface mount conductive pads along a first and a second edge of said second side;

a first connector mounted to said first side and having a plurality of high density contacts press-fit within said holes;

a second connector mounted to said second side of said circuit carrying substrate and having a plurality of low density contacts surface mounted to said conductive pads and located outwardly of said holes; and said circuit carrying substrate being parallel to the bases of said first and second connector.

* * * * *